United States Patent [19]

Ohta et al.

[11] Patent Number: 4,804,445

[45] Date of Patent: Feb. 14, 1989

[54] METHOD FOR THE SURFACE TREATMENT OF AN IRON OR IRON ALLOY ARTICLE

[75] Inventors: Yukio Ohta; Shigeo Moriyama; Akira Sato; Tohru Arai; Hironori Fujita; Yoshihiko Sugimoto, all of Aichi, Japan

[73] Assignee: Kabushiki Kaisha Toyota Chuo Kenkyusho, Japan

[21] Appl. No.: 123,269

[22] Filed: Nov. 20, 1987

[30] Foreign Application Priority Data

Dec. 17, 1986 [JP] Japan ..... 61-300667

[51] Int. Cl.[4] ..... C23C 8/32

[52] U.S. Cl. ..... 204/39; 148/15.5; 148/14; 148/6.11; 148/6

[58] Field of Search ..... 204/39; 148/15.5, 14, 148/6.11, 6

[56] References Cited

U.S. PATENT DOCUMENTS 3,719,518 3/1973 Komatsu ..... 148/15.5

3,827,920 8/1974 Shimoda ..... 148/15.5

*Primary Examiner*—Sam Silverberg

*Attorney, Agent, or Firm*—Berman, Aisenberg & Platt

[57] ABSTRACT

A surface layer which is composed of the carbonitride of molybdenum is formed on an article made of iron or an iron alloy by heating the article in the presence of a material containing molybdenum and a treating agent. The treating agent may be composed of at least one of the cyandides and cyanates of alkali metals and alkaline earth metals. The layer adhering closely to the article can be formed efficiently at a temperature which is so low that virtually no thermal strain may develop in the article.

14 Claims, 3 Drawing Sheets

(x 400)

(x400)

(x400)

METHOD FOR THE SURFACE TREATMENT OF AN IRON OR IRON ALLOY ARTICLE

RELATED APPLICATIONS

The subject matter of the application is related to that of application Ser. No. 23,862, filed Feb. 3, 1987, now U.S. Pat. No. 4,765,847 and to that of application Ser. No. 80,828, filed July 24, 1987.

BACKGROUND OF THE INVENTION

1. Field of the Invention

This invention relates to a method for surface treatment which forms a layer of molybdenum (Mo) carbonitride on the surface of any articles made of iron or an iron alloy, such as dies, jigs, tools and machine parts.

2. Description of the Prior Art

Carbides of molybdenum (Mo), such as $Mo_2C$ and $(Mo,Fe)_6C$, has a hardness of more than Hv 1500 and have superior resistance to wear and seizure than that of the carbide of iron ($Fe_3C$) or the nitride of iron ($Fe_{2\sim3}N$). Molybdenum carbide has been made to exist in high speed steel in the form of $(Mo,Fe)_6C$ to improve wear resistance in addition to hardness. However, the carbide of Mo has a lower hardness and a poorer wear resistance than those of the carbide of V, Ti or the like, having a hardness of about Hv 3000 and, therefore, there have been only few practical uses thereof for a wear resistant coating layer. In addition, MoN is also poor in wear resistance compared with VN, TiN. Although MoS is an excellent solid lubricant, the seizure resistance of the carbide and nitride of Mo has not sufficiently been examined. The inventors of this invention have found that the carbonitride of Mo exhibits an excellent seizure resistance, and they conceived of forming a surface layer composed of the carbonitride of Mo on the surface of iron or an iron alloy article (hereinafter referred to as an article to be treated) thereby to improve the properties of the article to be treated.

In a conventional method for coating the carbide of molybdenum, the iron alloy article is immersed in a molten salt bath composed of the chloride system to form a layer of the carbide of molybdenum on the surface of the article.

According to the above method, however, the article is heated at a temperature which is higher than the $A_{c1}$ transformation point of iron, which is about 700° C. The heat is likely to develop (in the article) a stress which causes it to crack if it has a complicated shape. Moreover, it worsens the working environment, because treatment is done at high temperatures.

To form a surface layer containing molybdenum, there have also been proposed methods which employ a temperature which is lower than about 700° C. They include CVD (chemical vapor deposition) and PVD (physical vapor deposition) employing halides of molybdenum. It is, however, difficult to form by any of those methods a layer having a uniform thickness and adhering closely to the surface of the article. They involve a complicated process which requires expensive facilities. Moreover, they require the presence of hydrogen or a reduced pressure which lowers the efficiency of the operation.

SUMMARY OF THE INVENTION

Under these circumstances, it is an object of this invention to provide a method which can form a layer of the carbonitride of molybdenum adhering closely to the surface of an article made of iron or an iron alloy, efficiently by employing a very simple apparatus and heating the article at a low temperature so that no thermal strain may develop therein.

According to a first aspect of this invention, there is provided a method for the surface treatment of an article made of iron or an iron alloy which comprises preparing a material containing molybdenum and a treating agent comprising at least one of cyanides and cyanates of alkali metals and alkaline earth metals, and heating the article in the presence of the material and the treating agent at a temperature not more than 650° C. so that molybdenum, nitrogen and carbon may be diffused through the surface of the article to form a surface layer composed of the carbonitride of molybdenum.

According to a second aspect of this invention, there is provided a method for the surface treatment of an article made of iron or an iron alloy which comprises preparing a material containing molybdenum and a treating agent comprising at least one of cyanides and cyanates of alkali metals and alkaline earth metals and at least one of the chlorides, borofluorides, fluorides, oxides, bromides, iodides, carbonates, nitrates and borates of alkali metals and alkaline earth metals, and heating the article in the presence of the material and the treating agent at a temperature not more than 650° C. so that molybdenum, nitrogen and carbon may be diffused through the surface of the article to form a surface layer composed of the carbonitride of molybdenum.

The use of the specific treating agent enables the formation of an excellent surface layer composed of the carbonitride of molybdenum at a low temperature not exceeding 650° C. The use of such a low temperature substantially prevents the development of any thermal strain in the iron or iron alloy of which the article is made, improves the ease of treatment and eliminates the consumption of a large amount of energy. As the layer is formed by diffusion, it has strong adhesion which cannot be achieved in any carbide or nitride layer formed by PVD not involving any diffusion. It also has a high degree of density and a practically satisfactory thickness.

The above and other objects, features and advantages of the present invention will become more apparent from the following description when taken in conjunction with the accompanying drawings in which a preferred embodiment of the invention is shown by way of illustrative examples.

DETAILED DESCRIPTION OF THE INVENTION

Figure 1:
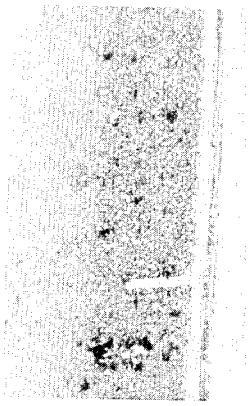
FIGS. 1, 3 and 5 are microphotographs of 400 magnifications, respectively, showing the cross-sectional structures of the surface layers formed by the method of this invention in EXAMPLES 1, 2 and 3, respectively, which will hereinafter be described.

According to this invention, a layer which is composed of the carbonitride of molybdenum, is formed on the surface of an article made of iron or an iron alloy. The article may be of any material containing carbon, such as carbon or alloy steel, cast iron or a sintered iron alloy, or of any material not containing carbon, such as pure iron. The material may or may not contain nitrogen.

The article is placed in a coexisting relationship with a material containing molybdenum and a treating agent and they are heated together so that molybdenum, nitrogen and carbon may be diffused through the surface of the article to form thereon a layer composed of the carbonitride of molybdenum. This layer is composed of the carbonitride consisting mainly of molybdenum. A diffusion layer, which is a solid solution of nitrogen and carbon in iron, is formed immediately under the carbonitride layer of molybdenum.

The material containing molybdenum is used to supply molybdenum which is diffused through the surface of the article. In this connection, it is possible to use metals, alloys, or compounds of molybdenum. Examples of the metals include pure molybdenum and the alloys thereof, such as ferromolybdenum (Fe-Mo) and the like. Examples of the compounds include chlorides, bromides and oxides, such as $MoCl_5$, $MoBr_3$ and $Na_2MoO_4$. One or more of these metals or compounds are employed. The use of an oxide of molybdenum, such as $MoO_3$ or the like, is particularly preferred from a practical standpoint.

The treating agent is used to supply nitrogen and carbon which are diffused through the surface of the article and also serves as a medium which assists the diffusion of molybdenum therethrough. It is composed of one or more of the cyanides and cyanates of alkali metals and alkaline earth metals (hereinafter referred to as the first treating agent). It is also possible to use a mixture of the first treating agent and one or more of the chlorides, fluorides, borofluorides, oxides, bromides, iodides, carbonates, nitrates and borates of alkali metals and alkaline earth metals (hereinafter referred to as the second treating agent). The first treating agent supplies the nitrogen and carbon which are diffused through the surface of the article. The second treating agent is employed to control the melting point, viscosity, evaporation, etc. the first treating agent and improve the stability of the treatment, if required.

More specifically, the first treating agent may, for example, be NaCN, KCN, NaCNO or KCNO, or a mixture thereof. The second treating agent may, for example, be NaCl, KCl, $CaCl_2$, LiCl, NaF, KF, LiF, $KBF_4$, $Na_2CO_3$, $Li_2CO_3$, $K_2CO_3$, $NaNO_2$, $KNO_3$, LiBr, KI or $Na_2O$, or a mixture thereof.

When the material containing molybdenum is mixed with the treating agent, it is preferable to employ 0.5 to 70% by weight of the material based on the weight of the treating agent. There is a tendency that the amount out of this range makes it difficult to continuously form a surface layer, and it is easier to continuausly form a layer as the amount of the material approaches the middle value of the range.

For heat treatment, methods, such as immersion in a molten salt bath, electrolysis in a molten salt, application of a paste and the like, may be employed.

According to the immersion method, the treating agent is melted to form a molten salt bath and the material containing molybdenum and the article to be treated are immersed in the molten salt bath. When the material containing molybdenum is immersed in the molten treating agent, molybdenum is dissolved therein. The material which is immersed may, for example, be in the form of a powder having a particle size preferably under 200 mesh, or a thin plate. Alternatively, it may be a bar or plate serving as an anode so that the anodic dissolution of molybdenum may take place in the molten salt bath. Molybdenum is dissolved at a speed depending on the kind and size of the material which is employed. It is, therefore, necessary to hold the molten salt bath at or about a predetermined treating temperature for an appropriate length of time before immersion therein of the article to be treated.

The anodic dissolution of molybdenum proceeds quickly and thereby improves the efficiency of the treatment. It also has the advantage that no undissolved material collects in the bottom of the bath. A vessel which holds the molten salt bath, or another conductive material may be used as a cathode. The anodic dissolution proceeds at a high speed when the anode has a high current density. It is, however, sufficient to employ a relatively low current density insofar as no electrolysis is essentailly required for dissolving molybdenum. It is appropriate to employ a current density from 0.1 to 0.8 $A/cm^2$.

The molybdenum which has been dissolved, as well as the nitrogen and carbon which have been supplied by the treating agent, are diffused through the surface by the article to form a layer which is composed of the carbonitride of molybdenum. The vessel which holds the molten salt bath may be made of, e.g., graphite, titanium or steel. It is most preferable to use a carbonaceous vessel graphite or the like. In this case, a large amount of Mo can be diffused in the carbonitride layer as will later be described in Examples.

According to the electrolysis method, the material containing molybdenum is immersed in a molten salt bath of the treating agent so that molybdenum may be dissolved therein, and the article to be treated is immersed therein as a cathode, while a vessel which holds the molten salt bath or a separate conductive material is used as an anode. Molybdenum can be dissolved in a way which is similar to either of the ways which have hereinabove been described in connection with the immersion method. Alternatively, the meatrial containing molybdenum can be used as the anode, while the article to be treated serves as the cathode. This method has the advantage that the anodic dissolution of molybdenum and the formation of a surface layer can be accomplished simultaneously. In any event, the cathode may have a current density of 2 $A/cm^2$ or below. A range of from 0.05 to 1.0 $A/cm^2$ is practically appropriate.

Both of the above methods can be carried out either in an atmosphere exposed to the open air, or in the presence of a protective gas, such as nitrogen or argon.

According to the paste method, a paste is prepared from a mixed powder of the treating agent and the material contain molybdenum, or from a powder obtained by crushing a solidified product of a molten treating agent in which molybdenum has been dissolved, and the article to be treated is coated with the paste and heated.

The paste can be prepared by adding to the powder an aqueous solution of dextrin, glycerin, water glass, ethylene glycol, alcohol, etc., as a binder. The paste is applied to the surface of the article to form a layer usually having a thickness of at least 1 mm. Then, the article is usually placed in a container and is heated in a heating furnace. It is usually sufficient to heat the article in an atmosphere exposed to the open air. If a non-oxidizing atmosphere is employed, however, it is advantageously possible to apply a paste layer having a smaller thickness. This method has the advantage of enabling the formation of a surface layer on only that part or parts of the article to which the paste has been applied. The powder from which the paste is prepared may have a particle size which enables it to pass through, say, a sieve of 100 mesh. The use of a somewhat coarser or finer powder may, however, not present any substantial problem.

According to this invention, it is important to employ a heating temperature not exceeding 650° C. in order to ensure that substantially no strain develops in the substrate, i.e. the iron or iron alloy of which the article to be treated is made. It is, however, desirable to employ a temperature which is not lower than 450° C. If any temperature that is lower than 450° C. is employed, the surface layer can only be formed slowly. In practice, therefore, it is advisable to select a temperature of 500° C. to 650° C., which falls within the range of temperatures usually employed for the high temperature tempering of die steels or the tempering of structural steels.

With a longer treatment time, a thicker surface layer will result. Also, as the time is longer, the surface layer has a higher content of molybdenum. Therefore, the length of time to be selected for the treatment depends on the desired thickness of the surface layer to be formed or its desired content of molybdenum. It is usually in the range of from 1 to 50 hours.

Referring to the thickness of the surface layer, it is practically advisble that it have a total thickness of, say, 1 to 30 microns. A surface layer having a greater thickness may cause a reduction in toughness of the substrate and a spalling of the layer.

The inventors of this invention are not yet certain about the mechanism through which this invention enables the formation of a surface layer composed of the carbonitride of molybdenum. The following is, therefore, an assumption based on the results of their analysis by X-ray diffraction and an X-ray microanalyzer and their study of the relationship existing between the length of time spent for the treatment and the thickness of the layer thereby formed. In the following description, the letters "m", "n", "o" and "p" appearing as suffixes represent different numerals.

Nitrogen (N) and carbon (C) are diffused into the surface of the article made of iron or an iron alloy and react with iron (Fe) to form a layer of nitride which can be represented as $Fe_m(C,N)_n$. This nitride contains any carbon (C) or nitrogen (N) that the article may originally contain. A solid solution of nitrogen and carbon in iron which can be represented as Fe-N-C is formed immediately under the nitride layer. These reactions gradually proceed from the surface of the article to its interior.

The diffusion of nitrogen and carbon is immediately followed by the diffusion of, e.g., molybdenum (Mo) into the nitride layer, and these two kinds of diffusion proceed together. The latter diffusion is a reaction which causes Mo to replace Fe in $Fe_m(C,N)_n$ and thereby convert the nitride to $(Mo,Fe)_o(C, N)_p$. This reaction also gradually proceeds from the surface of the article to its interior. This layer of $(Mo,Fe)_o(C,N)_p$ has an outer surface portion toward which it appears to contain a large amount of molybdenum, and an inner surface portion contacting the substrate toward which it appears to contain a large amount of iron. Therefore, it may sometimes be more appropriate to express it as a layer of $Mo_o(C, N)_p$, insofar as its outer surface portion contains only a very small amount of iron.

Moreover, it is possible that other reactions may also take place to form a compound of Mo and N, or Mo, N and C on the surface of the substrate. The thickness of the $(Mo,Fe)_o(C,N)_p$ layer, the thickness of the layer formed by a solid solution of iron, nitrogen and carbon, the ratio of their thicknesses and their chemical compositions depend on the material of a substrate, the treating temperature and time, and the kind and the mixing ratio of the substrances in the treating agent, etc.

The inventors of this invention have previously proposed a method which treats the surface of an article made of an iron alloy to form thereon a layer composed of the nitride or carbonitride of molybdenum (Japanese Patent Application No. 288885/1985). This method essentially consists of two stages of treatment. The article is first subjected to nitriding treatment so that a nitrided layer composed of a compound of iron and nitrogen, or iron, carbon and nitrogen, may be formed on the surface of the article. Then, the article is placed in a coexisting relationship with a material containing molybdenum and a treating agent which is composed of one or more of the chlorides, fluorides, borofluorides, oxides, bromides, iodides, carbonates, nitrates and borates of alkali metals and alkaline earth metals or one or both of an ammonium halide and a metal halide, and they are heated together at a temperature not exceeding 700° C., so that molybdenum may be diffused into the nitrided layer to form on the article a surface layer composed of the nitride or carbonitride of molybenum.

This prior method and the method of this invention are similar to each other in that they can both form a surface layer composed of the carbonitride of molybdenum by employing a salt bath or paste process at a temperature which is sufficiently low to prevent substantially the development of any thermal strain in the substrate. This invention can, however, be significantly distinguished from the prior method in a number of other respects including the following:

(A) Properties of the product of treatment:

The products of the two methods under comparison greatly differ from each other in toughness, though they do not make any substantial difference in surface hardness, or wear or seizure resistance.

Referring to nitriding treatment in general, it is usual practice to avoid the formation of a layer of any compound on the surface of the substrate so that it may not lower its toughness. The prior method, however, makes it essential to form a layer of a compound having a large thickness. This necessarily results in the formation of a layer of a solid solution or iron and nitrogen which also has a large thickness. The presence of a large amount of nitrogen in solid solution is obvious from the results of analysis by an X-ray microanalyzer which will be referred to in further detail in the description of examples. The presence of these layers have an adverse effect on the toughness of the substrate.

On the other hand, according to the present invention, the amount of a solid solution of nitrogen in the substrate is extremely small and the thickness of a layer of a solid solution of iron, nitrogen and carbon is small, as will be obvious from the description of examples. Therefore, it apparently has a higher degree of toughness than any article treated by the prior method.

(B) Efficiency:

The method of this invention, which can form a surface layer by a single stage of treatment, is more efficient than the prior method which requires two different stages of treatment. Moreover, the method of this invention requires less facility, since it involves only a single stage of treatment.

The inventors of this invention engaged in concentrative investigations and a large number of practical experiments to obviate the problems of the prior method. As a result, they have found the method of this invention which can form a surface layer of the nitride or carbonitride by a single stage of treatment. The layer is substantially equal to that but more excellent in toughness than that obtained by two stages of treatment. As a nitride or carbonitride- forming element, there can be used vanadium (V), chromium (Cr), titanium (Ti), tungsten (W), molybdenum (Mo) or the like. These elements have free energy for nitride formation which is large in minus. In the case of the prior method based on two stages treatment, it was possible to form a surface layer of the nitrides or carbonitrides of all these elements. In the case of the method of this invention based on only a single stage of treatment, it was possible to form the nitrides or carbonitrides of V, Cr, and Mo, but it was difficult to form a surface layer composed of the nitrides or carbonitrides of Ti, W and Ta, in spite of the result of various studies and considerations thereabout.

Therefore, the surface layer forming reaction according to this invention is not explainable based on free energy for nitride formation.

The invention will now be described more specifically with reference to a variety of examples.

EXAMPLE 1

A graphite vessel holding a mixture consisting of 53% by weight of NaCNO, 12% by weight of KCl and 35% by weight of $CaCl_2$ was heated in an electric furnace in an atmospheric environment, whereby a molten salt bath at a temperature of 570° C. was prepared from those substances. A powder of pure molybdenum having a particle size under 100 mesh was added to the molten salt bath until it occupied 15% by weight of the molten salt bath. A sample of the material to be treated was immersed in the molten salt bath and after they had been held therein for a period of 8 hours, it was taken out and cooled by air. The sample was a round bar of high speed tool steel (JIS-SKH 51) having a diameter of 6 mm and a length of 20 mm. The sample was ground to expose a cross-sectional surface after any unnecessarily adhering bath material had been washed away, and the cross-sectional structure of the surface layer which had been formed thereon was examined through a microscope.

Figure 2:
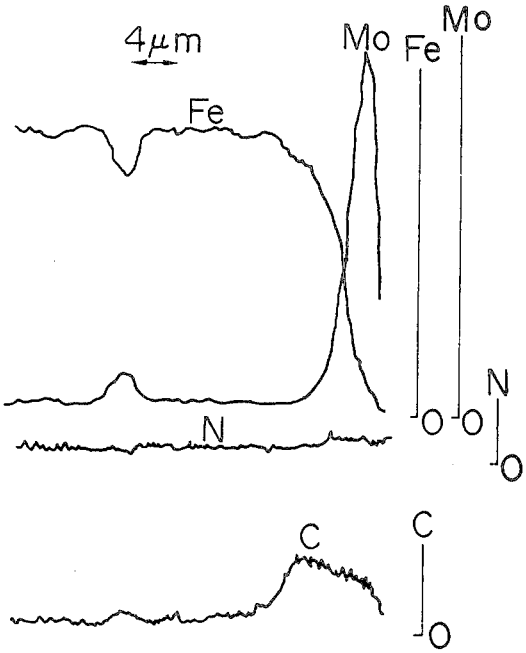
FIGS. 2, 4 and 6 are graphs showing the results of analysis by an X-ray microanalyzer of the surfaces of iron alloy articles treated by the method of this invention described in EXAMPLES 1, 2 and 3 respectively.

FIG. 1 is a microphotograph of 400 magnifications showing the cross-sectional structure of the sample. The formed layer was a layer having a smooth surface and composed of an inner layer having a thickness of about 5 μm and an outer layer having a thickness of about 3 μm. The cross-sectional structure of this sample was analyzed by an X-ray microanalyzer. The results are shown in FIG. 2. Nitrogen and carbon, as well as molybdenum and iron, were found in the surface layer. More molybdenum and nitrogen were found in the outer layer than in the inner layer, while more iron and carbon were found in the inner layer. Only a very small amount of a solid solution of nitrogen was found in the substrate immediately under the surface layer. The analysis of the layer through its outer surface indicated the presence of about 70% of molybdenum. The analysis of the layer by X-ray diffraction showed diffraction patterns corresponding to those of MoN(δ) and $(Mo,Fe)_6C$. Accordingly, it was evident that the inner layer was a layer of the carbonitride of molybdenum and iron expressed as $(Mo,Fe)_m(C,N)_n$, while the outer layer was a layer of the carbonitride of molybdenum including a very small amount of solid solution of Fe, expressed as (Mo,Fe)(C,N).

EXAMPLE 2

A graphite vessel holding a mixture consisting of 57% by weight of NaCNO, 13% by weight of NaCN, 9% by weight of NaCl and 21% by weight of $CaCl_2$ was heated in an electric furnace in an atmospheric environment, whereby a molten salt bath at a temperature of 570° C. was prepared from those substances. A powder of $MoO_3$ having a particle size under 325 mesh was added to the vessel until it occupied 15% by weight of the molten salt bath. A sample in the form of a round bar of JIS SKH51 high speed tool steel having a diameter of 8 mm and a length of 20 mm was immersed in the molten salt bath. After eight hours, it was taken out and cooled by air.

Figure 3:
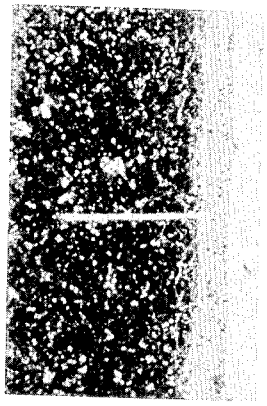
Figure 4:
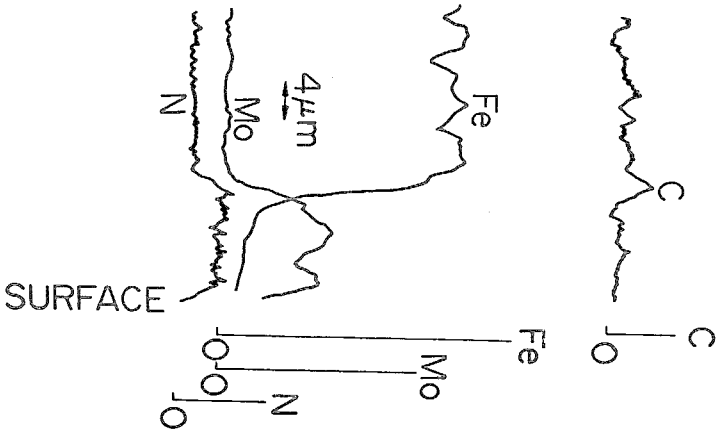

FIG. 3 is a microphotograph of 400 magnifications showing the cross-sectional structure of the sample. The surface layer which has been formed thereon was a double layer, the inner layer of which was extremely thinner than the outer layer thereof. The thickness of the inner layer was about 2 μm and the thickness of the outer layer was about 12 μm. The analysis of the layer by X-ray diffraction showed diffraction patterns corresponding to those of MoN(δ) and $(Mo,Fe)_6C$. From the result of the analysis by an X-ray microanalyzer shown in FIG. 4, it was confirmed that the outer layer was composed of the carbonitride of molybdenum and iron expressed as (Mo,Fe)(C,N). The inner layer was considered to be iron carbonitride expressed as $Fe_m(C,N)$, although it was difficult to be so defined because of the extremely thin layer thereof.

EXAMPLE 3

Figure 5:
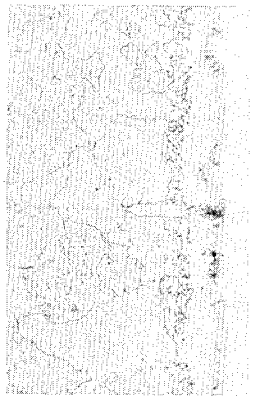
Figure 6:
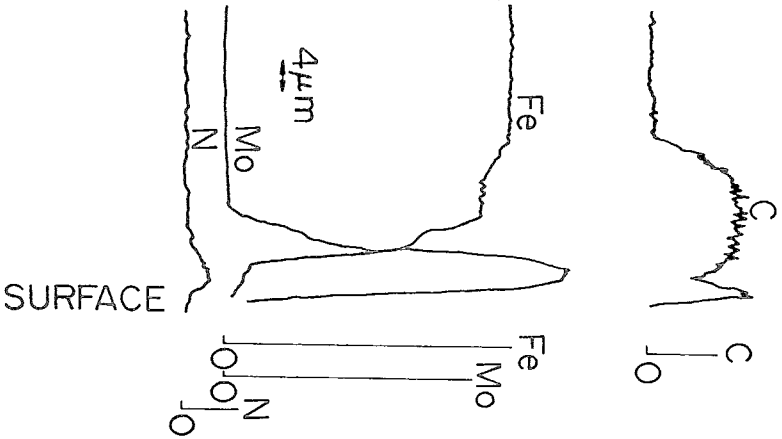

A graphite vessel holding a mixture consisting of 57% by weight of NaCNO, 13% by weight of NaCN, 9% by weight of NaCl and 21% by weight of $CaCl_2$ (i.e. of the same composition with the mixture employed in EXAMPLE 2) was heated in an electric furnace in an atmospheric environment, whereby a molten salt bath at a temperature of 610° C. was prepared from those substances. In addition, a powder of $MoO_3$ having a particle size under 325 mesh was added to the vessel until it occupied 15% by weight of the molten salt bath. A sample in the form of a round bar of industrial pure iron, having a diameter of 7 mm and a length or 20 mm, was immersed in the molten salt bath. After eight hours, it was taken out and cooled by air. The cross-sectional structure of the sample was shown in FIG. 5. The layer formed on its surface was a double layer composed of an inner layer having a thickness of about 12 μm and an outer layer having a thickness of about 5 μm. The surface layer was analyzed by an X-ray microanalyzer and the result was shown in FIG. 6. The analysis of the layer by X-ray diffraction showed diffraction patterns corresponding to those of MoN(δ) and $Fe_3C$. Therefore, it was evident that the outer layer was the carbonitride of molybdenum and iron expressed as $(Mo,Fe)_m(C,N)_n$ and the inner layer was iron carbonitride, including a very small amout of solid solution of molybdenum, expressed as $Fe_o(C,N)_p$.

EXAMPLE 4

A graphite vessel holding a mixture consisting of 53% by weight of NaCNO, 12% by weight of KCl and 35% by weight of $CaCl_2$ (i.e. of the same composition as the mixture employed in EXAMPLE 1) was heated in an electric furnace in an atmospheric environment, whereby a molten salt bath at a temperature of 570° C. was prepared. A plate of pure molybdenum having a length of 60 mm, a width of 30 mm and a thickness of 4 mm was placed in the center of the molten salt bath. An electric current was passed through the bath between the molybdenum plate serving as an anode and the graphite vessel serving as a cathode for about 16 hours in such a way that the anode might have a current density of 0.6 A/cm$^2$. The resulting weight loss of the molybdenum sheet indicated that as a result of anodic dissolution, the bath contained about 5% of molybdenum. A sample in the form of a round bar of JIS SKH51 high speed tool steel having a diameter of 6 mm and a length of 20 mm was immersed in the molten salt bath and after 24 hours, it was taken out and cooled by air.

The sample was cut to expose a cross-sectional surface and the cross-sectional structure of the surface layer which had been formed thereon was examined by an optical microscope. It was a double layer composed of an inner layer having a thickness of about 10 $\mu$m and an outer layer having a thickness of about 2 $\mu$m in the same case as in EXAMPLE 2. The cross-sectional structure thereof was analyzed by an X-ray microanalyzer. As a result, iron, nitrogen and carbon, as well as about 50% of molybdenum, were found in the surface layer as a whole, and more molybdenum and nitrogen were found in the outer layer than in the inner layer, while more iron and carbon were found in the inner layer. The analysis of the layer by X-ray diffraction gave diffraction patterns corresponding to those of MoN($\delta$) and $(Mo,Fe)_6C$.

EXAMPLE 5

A stainless steel vessel holding a mixture consisting of 51% by weight of NaCNO, 21% by weight of NaCl and 28% by weight of $Na_2CO_3$ was heated in an electric furnace in an atmospheric environment, whereby a molten salt bath at a temperature of 650° C. was prepared from those substances. A powder of pure molybdenum having a particle size under 100 mesh was added to the vessel until it occupied 15% by weight of the molten salt bath. A sample in the form of a round bar of industrial pure iron having a diameter of 7 mm and a length of 20 mm was immersed in the bath. Electrolysis was conducted by passing an electric current through the bath between the iron bar serving as a cathode and the stainless steel vessel serving as an anode for a period of eight hours in such a way that the cathode might have a current density of 0.05 A/cm$^2$. Then, the sample was taken out of the bath and cooled by air.

The sample was cut and its cross-sectional structure was examined through an optical microscope. In the same case as in EXAMPLE 2, the surface layer formed on the sample was a double layer composed of an inner and an outer layer. From the results of analysis by an X-ray microanalyzer, about 30% of molybdenum and nitrogen were found in the outer layer, and more iron and carbon in the inner layer. These results were all comparable to what had been obtained from the other examples of this invention.

EXAMPLE 6

A mixture consisting of 45% by weight of NaCNO, 10% by weight of KCl, 25% by weight of $CaCl_2$ and 20% by weight of a powder of pure molybdenum was heated to a temperature of 650° C. and the molten mixture was carefully stirred to form a uniform bath. One part by weight of graphite and one part by weight of alumina powder were added to four parts by weight of the bath. They were carefully mixed to prepare a treating agent.

The treating agent was cooled and pulverized. Ethyl alcohol was added to the pulverized treating agent to form a slurry thereof. The slurry was applied to the surface of a sample of JIS S45C carbon steel to form a layer having a thickness of about 5 mm. After the slurry had been dried, the sample was heated at 570° C. for eight hours in a nitrogen atmosphere and was, then, cooled.

After the remaining treating agent had been removed from the sample, the surface layer which had been formed thereon was analyzed by X-ray diffraction and by an X-ray microanalyzer. It was a double layer including an inner layer of iron carbonitride expressed as $Fe_m(C, N)_n$ and an outer layer of the carbonitride of molybdenum and iron expressed as (Mo,Fe)(C, N.). It was comparable to the layer which had been obtained in EXAMPLE 3.

EXAMPLE 7

A heat resistant vessel holding a mixture consisting of 53% by weight of NaCNO, 12% by weight of KCl and 35% by weight of $CaCl_2$ (i.e. of the same composition with the mixture employed in EXAMPLE 1) was heated in an electric furnance in an atmospheric environment, whereby a molten salt bath at a temperature of 570° C. was prepared from those substances. A powder of pure molybdenum having a particle size under 100 mesh was added to the vessel until it occupied 15% by weight of the molten salt bath. A sample in the form of a round bar of JIS SKH51 steel having a diameter of 6.5 mm and a length of 40 mm, which had been hardened and tempered under standard conditions, was immersed in the bath and after eight hours, it was taken out and cooled by air. After the remaining bath material had been washed away, the surface layer which had been formed on the sample was subjected to analysis by X-ray diffraction. It gave diffraction patterns corresponding to those of MoN($\delta$) and $(Mo,Fe)_6C$.

The sample (hereinafter referred to as Sample No. 1) was subjected to a dry friction test by a Falex lubricant testing machine employing a piece of gas carburized JIS-SCM415 chromium molybdenum steel as a counter material. The test was continued for a period of four minutes at a load of 200 kg, a rotating speed of 300 rpm and a sliding speed of 0.1 m/sec. For the sake of comparison, a similar test was conducted on each of a sample of JIS-SKH51 steel as hardened and tempered (Sample No. S1) and a sample of SKH51 steel as nitrided (Sample No. S2)

Sample No. S1 showed a wear of about 17 mg/cm$^2$. It showed a coefficient of friction which was as high as 0.280 when measured 30 seconds after the test had been started. Sample No. S2 showed a wear of about 15 mg/cm$^2$ and its coefficient of friction was as high as 0.265 when measured 30 seconds after the test had been started. On the other hand, Sample No. 1 embodying this invention showed a wear which was as small as about 6 mg/cm$^2$ and its coefficient of friction was as low as 0.110 when measured 30 seconds after the test had been started.

A similar friction test was also conducted on each of a sample of JIS-SKH51 steel which had been coated with a layer of vanadium carbide (VC) having a thickness of about three microns by 1.5 hours of immersion in a molten salt bath having a temperature of 1020° C. and a sample of the same steel which had been coated with a layer of titanium carbonitride expressed as Ti(C,N) and having a thickness of eight microns by four hours of CVD at 850° C. The wear of each of these samples and its coefficient of friction were both substantially equal to those of Sample No. 1. Therefore, it is obvious that the surface layer which can be formed in accordance with the method of this invention is comparable in wear and seizure resistance to any surface layer formed by immersion in a high temperature molten salt bath or by CVD.

EXAMPLE 8

A heat resistant steel vessel holding a mixture consisting of 60% by weight of NaCN and 40% by weight of KCN was heated in an electric furnace in an atmospheric environment, whereby a molten salt bath at a temperature of 600° C. was prepared from those substances. A powder of $MoO_3$ having a particle size under 250 mesh was added to the vessel until it occupied 15% by weight of the molten salt bath. A sample in the form of a round bar of JIS SKH51 steel having a diameter of 8 mm and a length of 20 mm was immersed in the bath and after 2 hours, it was taken out and cooled by air.

After the remaining treating agent had been removed from the sample, it was subjected to analysis by X-ray diffraction and by an X-ray microanalyzer. The surface layer which had been formed thereon was a layer of the carobnitride of molybdenum and iron consisting mainly of a mixture of MoN(δ) and $(Mo,Fe)_6C$.

What is claimed is:

1. A method for forming a surface layer composed of a carbonitride of molybdenum on the surface of an iron or iron alloy article, comprising preparing a material containing molybdenum and a treating agent comprising at least one of cyanides and cyanates of alkali metals and alkaline earth metals, and heating said article in the presence of said material and said treating agent at a temperature not more than 650° C., thereby diffusing molybdenum, nitrogen and carbon into the surface of said article.

2. A method according to claim 1, wherein said material comprises at least one material selected from the group consisting of pure molybdenum, molybdenum alloys and molybdenum compounds.

3. A method according to claim 1, wherein the amount of said material is 0.5 to 70% by weight of said treating agent.

4. A method according to claim 1, wherein said material and said article are immersed in a molten salt bath containing said treating agent.

5. A method according to claim 1, wherein said material is immersed in a molten salt bath containing said treating agent and said article is immersed in said bath as a cathode so as to form said surface layer through electrolysis.

6. A method according to claim 1, wherein said material and said treating agent both in the form of a powder are mixed and formed into a paste, said paste being applied to said article prior to said heating.

7. A method according to claim 1, wherein said temperature is at least 450° C.

8. A method according to claim 1, wherein said treating agent further comprises at least one of the chlorides, fluorides, borofluorides, oxides, bromides, iodides, carbonates, nitrates and borates of alkali metals and alkaline earth metals.

9. A method according to claim 8, wherein said material comprises at least one material selected from the group consisting of pure molybdenum, molybdenum alloys and molybdenum compounds.

10. A method according to claim 8, wherein said material is employed in a quantity which is equal to 0.5 to 70% by weight of said treating agent.

11. A method according to claim 8, wherein said material and said article are immersed together in a molten salt bath containing said treating agent.

12. A method according to claim 8, wherein said material is immersed in a molten salt bath containing said treating agent and said article is immersed in said bath as a cathode so that electrolysis may take place to form said layer.

13. A method according to claim 8, wherein said material and said treating agent are both in the form of a powder and a paste prepared from a mixture thereof is applied to said article before they are heated.

14. A method according to claim 8, wherein said temperature is at least 450° C.

* * * * *

UNITED STATES PATENT OFFICE

CERTIFICATE OF CORRECTION

Patent No. 4,804,445 Dated February 14, 1989

Inventor(s) Tohru ARAI, Hironori FUJITA, Yoshihiko SUGIMOTO, Yukio OHTA, Shigeo MORIYAMA and Akira SATO It is certified that error appears in the above-identified patent and that said Letters Patent is hereby corrected as shown below:

Cover page, item [75] should read:--Inventors: Tohru Arai, Hironori Fujita, Yoshihiko Sugimoto, Yukio Ohta, Shigeo Moriyama and Akira Sato - all of Aichi, Japan--.

Signed and Sealed this

Twenty-eighth Day of April, 1992

*Attest:*

HARRY F. MANBECK, JR.

*Attesting Officer*

*Commissioner of Patents and Trademarks*